United States Patent [19]

Lower

[11] 4,325,279

[45] Apr. 20, 1982

[54] SOUND BOX FOR MUSICAL INSTRUMENT

[76] Inventor: Louie H. Lower, P.O. Box 151, Hayden Lake, Id. 83835

[21] Appl. No.: 196,380

[22] Filed: Oct. 14, 1980

[51] Int. Cl.[3] ..... G10D 1/02

[52] U.S. Cl. ..... 84/275

[58] Field of Search ..... 84/275, 276, 277, 291

[56] References Cited

U.S. PATENT DOCUMENTS

| | | | |
|---|---|---|---|
| 882,702 | 3/1908 | Loppentien | 84/275 |
| 3,136,196 | 6/1964 | Charlesworth | 84/275 |
| 3,494,241 | 2/1970 | Jones | 84/291 X |

*Primary Examiner*—Lawrence R. Franklin

[57] ABSTRACT

A musical instrument sound box comprising a front wall and a back wall, string retainer mountings disposed on the box and adapted to retain strings proximate an outward surface of the front wall, one of the walls having distinct zones of wall thickness, a first zone of most wall thickness being proximate a central portion of the wall, a last zone of least wall thickness being most removed from the central portion, and intermediate zones between the first and last zones and having wall thicknesses progressively less than the first zone.

10 Claims, 7 Drawing Figures

SOUND BOX FOR MUSICAL INSTRUMENT

BACKGROUND OF THE INVENTION

Field of the Invention

This invention relates to musical instruments and is directed more particularly to a sound box for a string instrument.

SUMMARY OF THE INVENTION

An object of the present invention is to provide a sound box for a string instrument, the box being of unique interior configuration.

In accordance with the above and other objects, as will hereinafter appear, a feature of the present invention is the provision of a musical instrument sound box including a front wall, a back wall, the front and back walls being interconnected by a side wall, string retainer means disposed on the box and adapted to retain strings proximate an outward surface of the front wall, a first of the front and back walls having distinct zones of wall thickness, a first zone of most wall thickness being proximate a central portion of the first wall, a last zone of least wall thickness being most removed from the central portion, and intermediate zones between the first and last zones and having wall thicknesses progressively less than the first zone.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
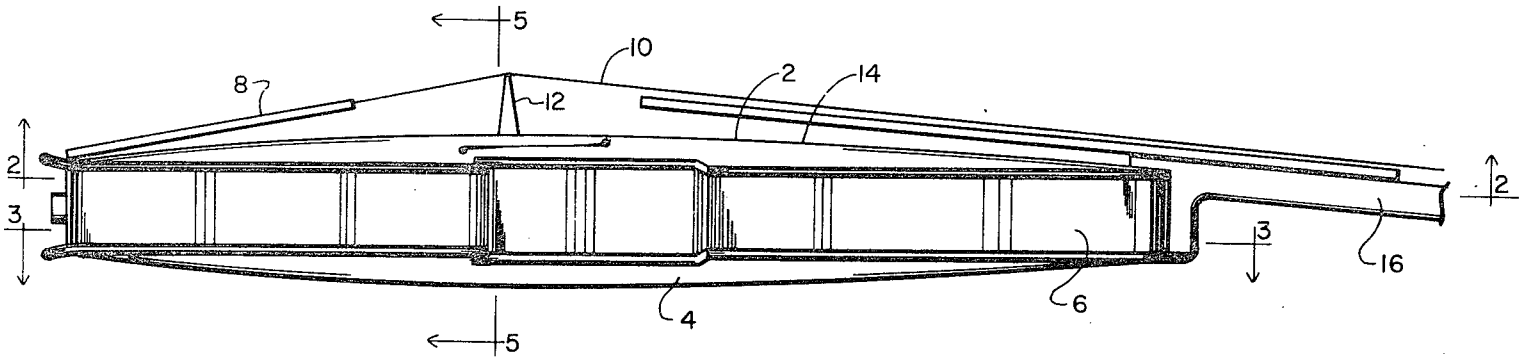
FIG. 1 is a side elevational view of one form of sound box illustrative of an embodiment of the invention.

Referring to the drawings, it will be seen that the sound box includes a front wall, or soundboard 2, and a back wall, or backboard 4, interconnected by a side wall 6. A tail-piece 8 is fixed to the sound box for retaining strings 10, a bridge member 12 supporting the strings 10 proximate but removed from an outward surface 14 of the soundboard 2. A fingerboard 16 (shown in part) is attached to and extends from the sound box.

Figure 2:
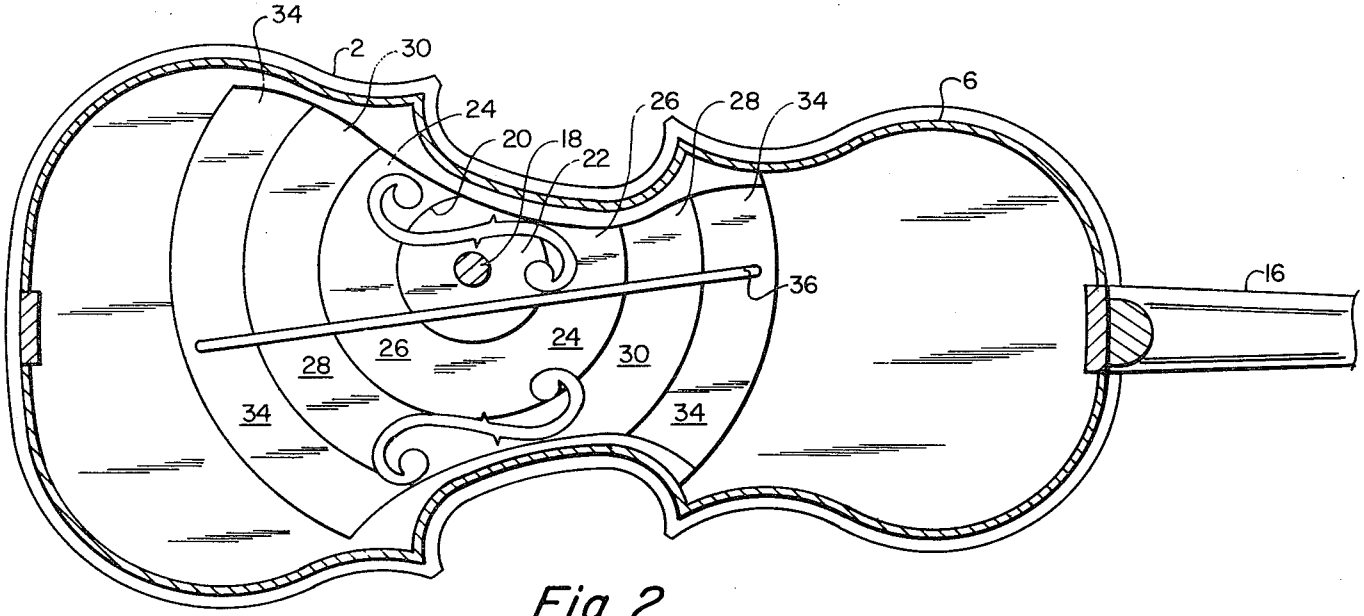
FIG. 2 is a sectional view taken along line 2—2 of FIG. 1.
Figure 5:
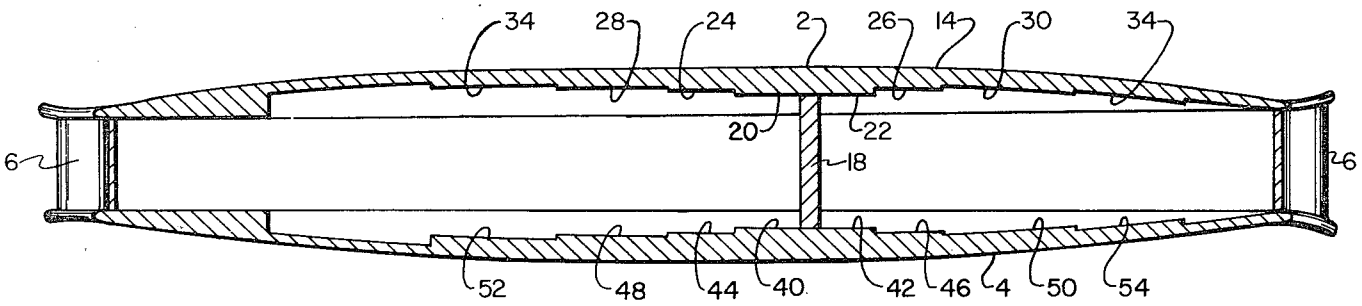
FIG. 5 is a sectional view taken along line 5—5 of FIG. 1.
Figure 6:
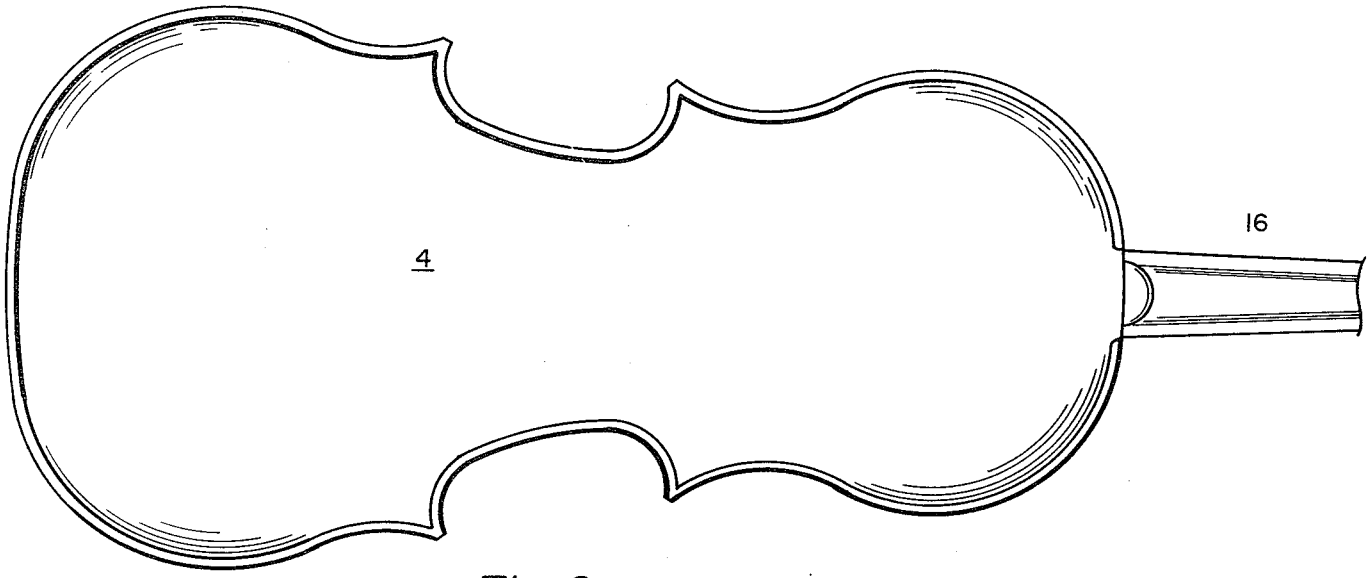
FIG. 6 is a back elevational view.
Figure 7:
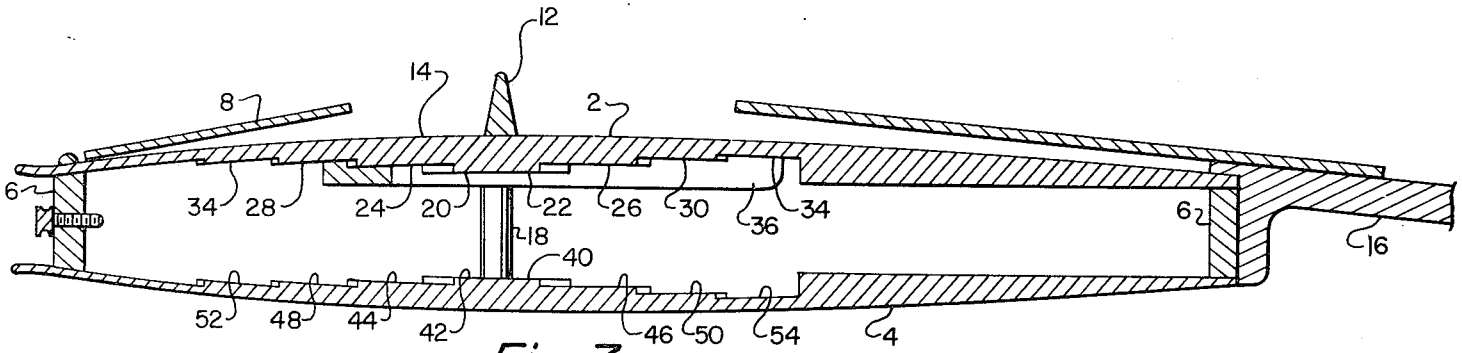
FIG. 7 is a sectional view taken along line 7—7 of FIG. 4.

Referring particularly to FIGS. 2, 5 and 7, it will be seen that the sound box is provided with a sound post 18 extending between the soundboard and backboard, the sound post being disposed centrally of a circular portion 20 of the soundboard 2 having a wall thickness of about 0.125 inch and of a diameter of about 3 inches, the portion 20 defining a first zone 22 of a selected wall thickness.

Adjacent the first zone 22 is a second zone 24 forming an interrupted annulus 26 around the first zone 22. In the second zone 24, the thickness of the soundboard is about 0.11 inch and the zone is about 0.75 inch across, measured at a radius extending from the center of the first zone 22, or the center of the sound post 18.

Adjacent the second zone 24 and forming an interrupted annulus 28 around the second zone 24 is a third zone 30. In the third zone 30, the thickness of the soundboard is about 0.10 inch and the zone is about 1.0 inch across.

Adjacent the third zone 30 is a last zone 34. In the last zone 34, the thickness of the soundboard is about 0.09 inch and the zone is about 1.125 inch across.

Thus, there is provided a circular first zone, with annular intermediate zones thereabout and a last zone about the furthest-out intermediate zone. Going outwardly from the sound post 18, the thicknesses of the soundboard decrease in stepped fashion, and the widths of the annular zones increase.

Formed so as to attach to the undersurface of the soundboard is a bass bar 36, which is of wooden material. The bass bar is in accordance with known features for such soundboards, except that in this instance it must be formed so as to fit the stepped interior configuration of the soundboard.

Figure 3:
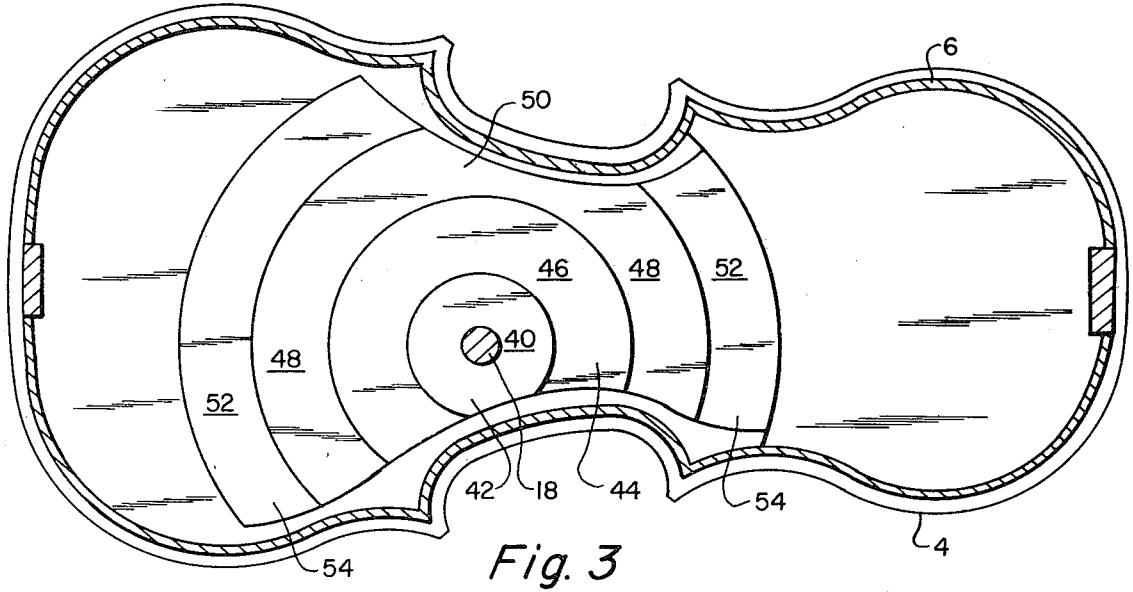
FIG. 3 is a sectional view taken along line 3—3 of FIG. 1.
Figure 4:
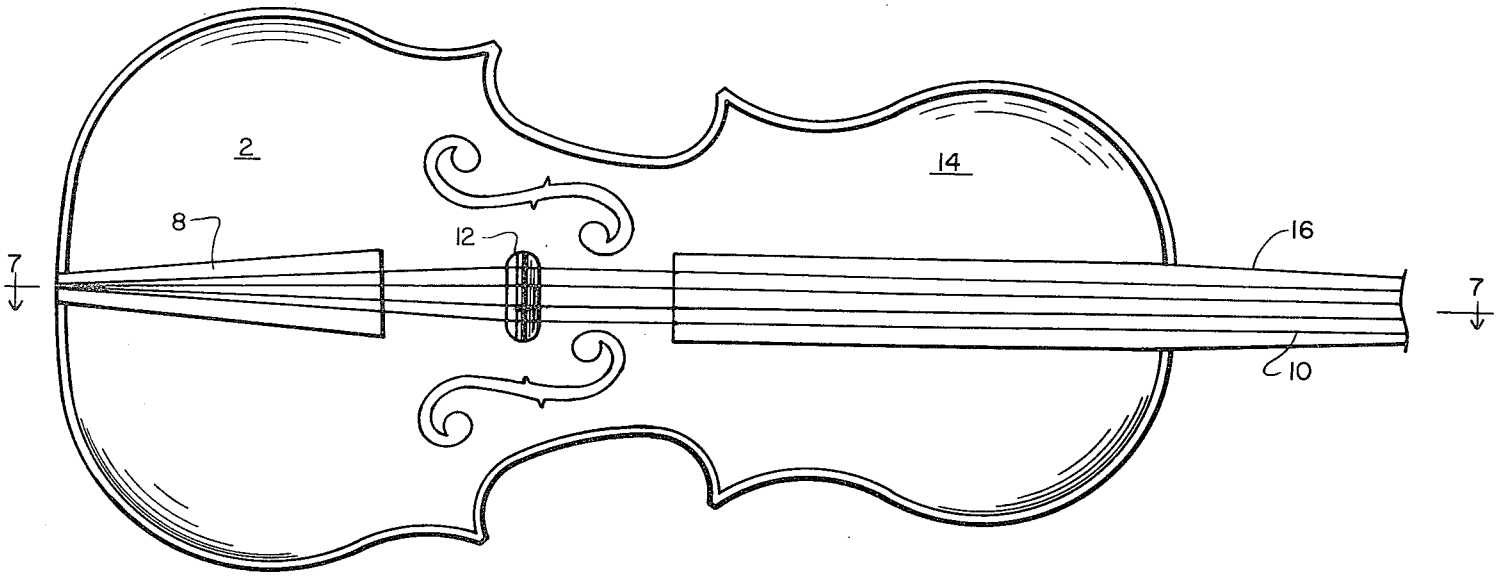
FIG. 4 is a front elevational view.

The back wall 4 is provided with a circular portion 40 (FIGS. 3, 5 and 7) disposed about the sound post 18, the back wall circular portion 40 having a wall thickness of about 0.18 inch and a diameter of about 3 inches, the portion 40 defining a first zone 42 of a selected wall thickness.

Adjacent the back wall first zone 42 is a second zone 44 forming an interrupted annulus 46 around the first back wall zone 42. In the second back wall zone 44, the thickness of the back wall is about 0.16 inch and the zone is about 0.75 inch across.

Adjacent the second back wall zone 44 and forming an interrupted annulus 48 around the second zone 44 is a third back wall zone 50. In the third zone 50, the thickness of the back wall is about 0.125 inch and the zone is about 1.0 inch across.

Adjacent the third back wall zone 50 and forming an interrupted annulus 52 around the third zone 50 is a last zone 54. In the last zone 54, the thickness of the back wall is about 0.09 inch and the zone is about 1.125 inch across.

Accordingly, in the back wall, as in the soundboard, there is provided a circular first zone, with annular intermediate zones thereabout and a last zone about the furthest-out intermediate zone. Going outwardly from the sound post 18, the thicknesses of the back wall decrease in stepped fashion, and the widths of the annular zones increase.

The soundboard first zone 22 and the back wall first zone 42 are in alignment and opposed. In like manner, the intermediate zones of the soundboard 24, 30 are in respective alignment and opposition to the intermediate zones 44, 50 of the back wall. Similarly, the soundboard last zone 34 is in alignment with, and is opposed to, the back wall last zone 54.

In an alternative embodiment (not shown) there is included an additional intermediate zone bounding the first zone and having a soundboard thickness of about 0.117 inch and a back wall thickness of about 0.17 inch, the zones being of about 0.62 inch in width.

In use, the stepped circular band configuration of the interiors of the front and back walls of the sound box cause a unique musical sound to be emitted when the violin is played in a customary manner.

It is to be understood that the present invention is by no means limited to the particular construction herein disclosed and/or shown in the drawings, but also comprises any modifications or equivalents within the scope of the disclosure. For example, other combinations of wall thicknesses and zone widths have been found suitable and capable of producing varied musical sound effects. In each instance, however, the zones going from center outwardly are of increasing widths and decreasing wall thicknesses.

Having this described my invention what I claim as new and desire to secure by Letters Patent of the United States is:

1. A musical instrument sound box comprising a front wall, a back wall, said front and back walls being interconnected by a side wall, string retainer means disposed on said box and adapted to retain strings proximate an outward surface of said front wall, a first of said front and back walls having distinct zones of wall thickness, a first zone of most wall thickness being proximate a central portion of said first wall, a last zone of least wall thickness being most removed from said central portion, and an intermediate zone between said first and said last zones, and having a wall thickness less that said first zone, said first zone being substantially circular, and said intermediate and last zones being of generally interrupted annular configuration disposed concentrically about said first zone.

2. The invention in accordance with claim 1 in which said outward surface of said first wall is substantially smooth and an inner surface of said first wall is stepped to define said distinct wall thickness zones.

3. The invention in accordance with claims 1 or 2 in which a second of said front and back walls is provided with distinct zones of wall thickness, a first second wall zone of most wall thickness being proximate a central portion of said second wall, a last second wall zone of least wall thickness being most removed from said second wall central portion, and an intermediate second wall zone between said first and said last second wall zones, and having a wall thickness less than said second wall first zone.

4. The invention in accordance with claim 3 in which said second wall first zone is substantially circular, and said second wall intermediate and last zones are of generally interrupted annular configuration disposed concentrically about said second wall first zone.

5. The invention in accordance with claim 4 in which said outward surface of said second wall is substantially smooth and an inner surface of said second wall is stepped to define said distinct thicknesses.

6. The invention in accordance with claim 5 in which corresponding wall thickness zones are aligned and opposed to define distinct sound box zones.

7. The invention in accordance with claim 6 in which said last zones each have a width measured radially from the center of said first zones which is greater than the width of said intermediate zones.

8. The invention in accordance with claim 6 in which said first zone is circular and is concentric with a sound post.

9. The invention in accordance with claim 8 in which said first zone is of about 3 inches in diameter.

10. The invention in accordance with claim 6 including a plurality of intermediate zones, said last zones each having a width measured radially from the center of said first zones which is greater than the width of an outward intermediate zone adjacent said last zone, and said outward intermediate zones each having a width which is greater than the width of an adjacent next inward zone, the widths of said intermediate zones being progressively less from the last zone inward to the first zone.

* * * * *